US007338182B1

(12) United States Patent
Hastings et al.

(10) Patent No.: US 7,338,182 B1
(45) Date of Patent: Mar. 4, 2008

(54) LIGHTING FIXTURE HOUSING FOR SUSPENDED CEILINGS AND METHOD OF INSTALLING SAME

(75) Inventors: Mark J. Hastings, New Berlin, WI (US); Kevin L. Willmorth, Germantown, WI (US)

(73) Assignee: Oldenburg Group Incorporated, Glendale, WI (US)

( * ) Notice: Subject to any disclaimer, the term of this patent is extended or adjusted under 35 U.S.C. 154(b) by 162 days.

(21) Appl. No.: 11/225,805

(22) Filed: Sep. 13, 2005

Related U.S. Application Data

(60) Provisional application No. 60/609,383, filed on Sep. 13, 2004.

(51) Int. Cl.
*F21S 8/06* (2006.01)

(52) U.S. Cl. ..... 362/150; 362/365; 362/368; 362/347; 362/404

(58) Field of Classification Search ..... 362/150, 362/360, 365, 217, 341, 347, 362, 364, 368, 362/148, 404; D26/74, 88, 89
See application file for complete search history.

(56) References Cited

U.S. PATENT DOCUMENTS

| | | | | |
|---|---|---|---|---|
| 2,831,962 | A | 4/1953 | Winkler et al. | |
| 2,854,205 | A | 9/1958 | Kruger | |
| 3,045,577 | A * | 7/1962 | Lazerson | 362/365 |
| 3,308,288 | A | 3/1967 | Ades | |
| 3,426,188 | A | 2/1969 | Baranowski | |
| 3,590,135 | A | 6/1971 | Herbenar et al. | |
| 3,654,849 | A * | 4/1972 | Shepherd | 362/150 |
| 3,720,432 | A | 3/1973 | Chudler | |
| 3,883,732 | A * | 5/1975 | Peterson et al. | 362/150 |
| 4,086,480 | A | 4/1978 | Lahm | |
| 4,494,175 | A * | 1/1985 | Gawad et al. | 362/150 |
| 4,613,929 | A | 9/1986 | Totten | |
| 4,631,648 | A | 12/1986 | Nilssen | |
| 4,716,504 | A | 12/1987 | Pahl et al. | |
| 4,814,954 | A | 3/1989 | Spitz | |
| 4,860,180 | A | 8/1989 | Degelmann | |
| 4,979,491 | A * | 12/1990 | DeMeritt | 362/422 |
| 5,161,878 | A * | 11/1992 | Degelmann et al. | 362/150 |
| 5,174,642 | A | 12/1992 | Brohard et al. | |
| 5,806,972 | A * | 9/1998 | Kaiser et al. | 362/290 |
| 5,823,663 | A * | 10/1998 | Bell et al. | 362/362 |
| 6,079,851 | A | 6/2000 | Altman et al. | |
| 6,210,025 | B1 * | 4/2001 | Schmidt et al. | 362/362 |
| 6,752,513 | B2 | 6/2004 | Plunk | |

* cited by examiner

*Primary Examiner*—Ismael Negron
(74) *Attorney, Agent, or Firm*—Reinhart Boerner Van Dueren S.C.

(57) ABSTRACT

A lighting fixture housing includes two end caps, a reflector assembly, and a ballast box cover. The two end caps further include top and bottom flanges and mounting brackets having support tabs extending thereon. The lighting fixture housing is installed by first sliding the end caps into position at opposite ends of an opening in a suspended ceiling formed of a T-bar grid, and then attaching the reflector assembly to the end caps. The reflector assembly may be temporarily suspended from the end caps so that electrical connections to the assembly are made and the ballast box cover installed.

20 Claims, 8 Drawing Sheets

FIG. 1
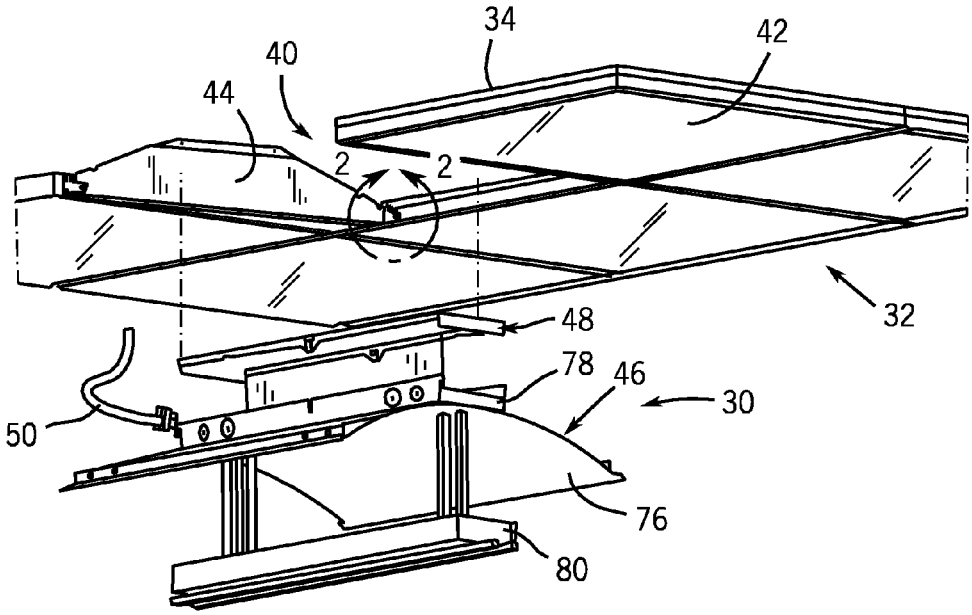
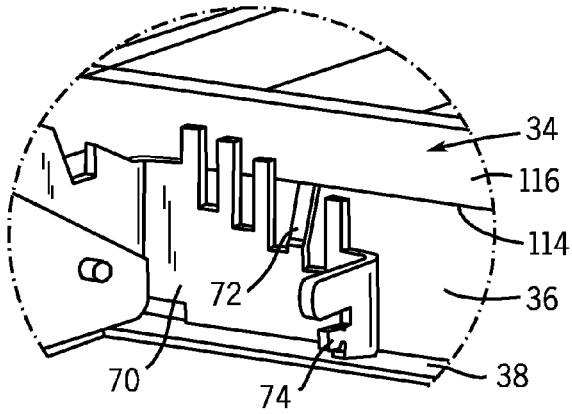
FIG. 2

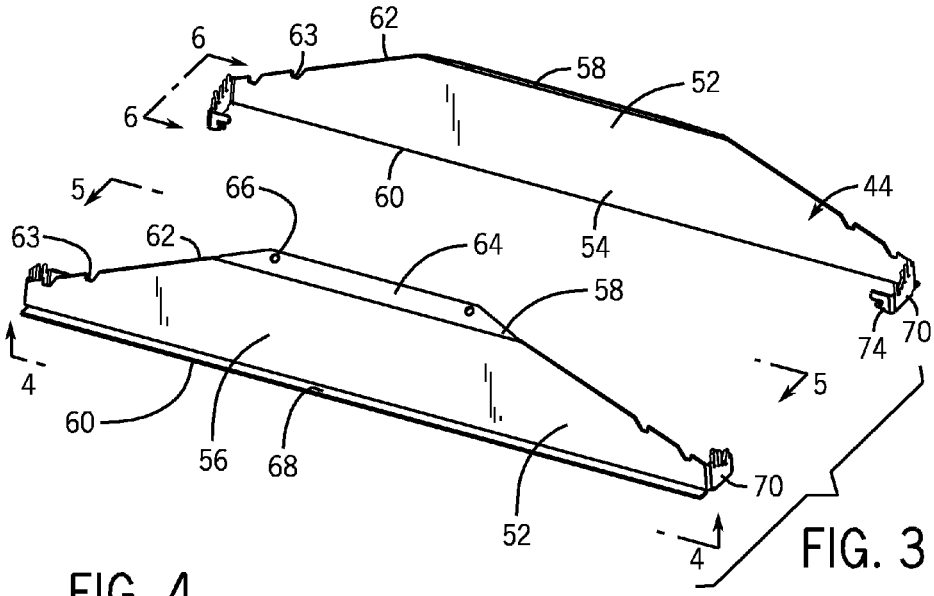
FIG. 3
FIG. 4
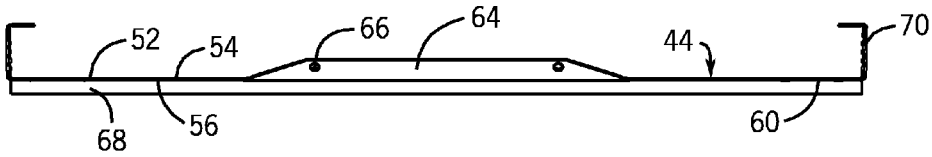
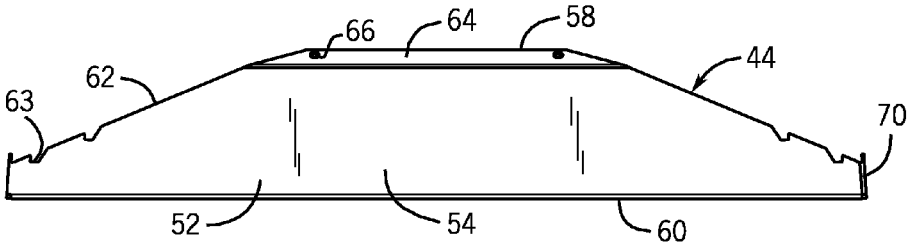
FIG. 5
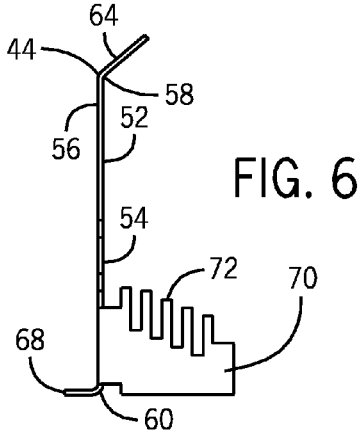
FIG. 6

FIG. 14
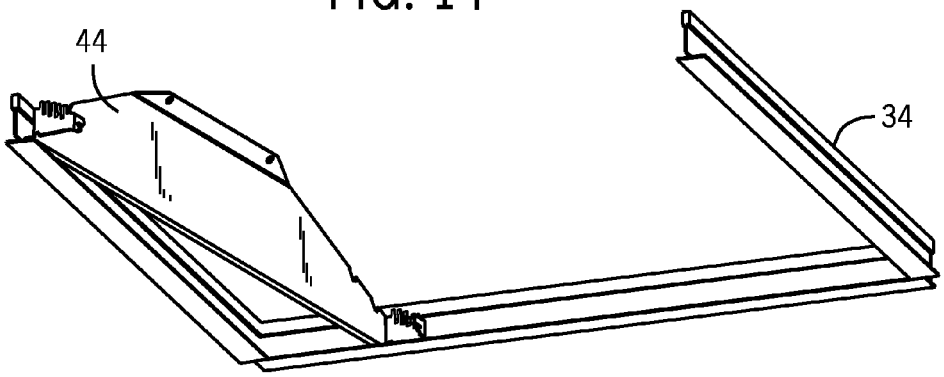
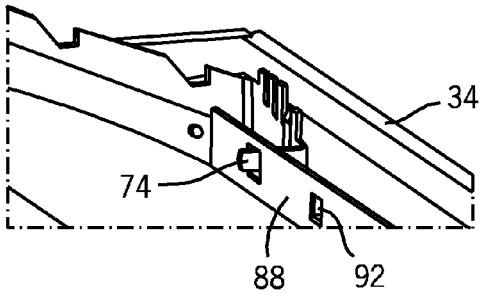
FIG. 15

LIGHTING FIXTURE HOUSING FOR SUSPENDED CEILINGS AND METHOD OF INSTALLING SAME

This application claims the benefit of U.S. Provisional Patent Application No. 60/609,383, filed on Sep. 13, 2004.

FIELD OF THE INVENTION

The present invention pertains generally to lighting fixtures and, more particularly, to lighting fixtures to be installed in suspended or false ceilings and methods for installing such lighting fixtures.

BACKGROUND OF THE INVENTION

Suspended ceilings, sometimes also known as false ceilings, are very common features of commercial, retail and many other buildings. A suspended ceiling is formed of a grid that is suspended from a permanent ceiling or structure and ceiling tiles supported by the grid. The suspended ceiling grid is formed of a series of beam structures having a cross-section in the shape of an inverted T, i.e., having a vertical rib and two horizontal flanges extending from the bottom of the vertical rib along the length of the beam. Hereinafter these grid pieces will be referred to as T-bars. The T-bars forming the suspended ceiling grid are suspended from the permanent ceiling above via wires or other structures. (Along the walls of a room in which a suspended ceiling is installed the beam structures employed have an L-shaped cross section, i.e., having a vertical rib portion that is attached to the wall and a horizontal flange portion extending from the vertical rib portion along the length thereof into the room.) The T-bars forming the suspended ceiling are laid out to define a grid of square or rectangular openings between the T-bars. The openings typically are 2 feet by 2 feet square or 2 feet by 4 feet in size (although other sized openings also may be defined). Ceiling tiles of the appropriate size are placed in the openings and supported along their edges by the horizontal flanges of the T-bars forming the suspended ceiling grid to complete the suspended ceiling. The ceiling tiles, also known as acoustical tiles, typically are made of a generally sound and heat insulating material, such as foam or the like, with a lower surface, that is visible to those in the room below the ceiling, decoratively formed. The space between the suspended ceiling thus formed by the T-bar grid and ceiling tiles and the permanent ceiling structure forms a convenient space for running various utilities, such as heating, ventilation and air conditioning ducts, electrical wiring, etc. The suspended ceiling hides these utilities from view while also allowing access thereto, by removing ceiling tiles and/or pieces of the T-bar grid from the suspended ceiling, for servicing when necessary.

Besides the ceiling tiles, the suspended ceiling grid also is used to support various other structures and devices, such as lighting fixtures, heating, ventilation and air conditioning vents, fire and smoke alarms, motion detectors, etc. These structures and devices may be attached to and/or supported by the suspended ceiling grid so as to extend at least partially below the suspended ceiling into the room below or may be entirely recessed above the plane of the suspended ceiling grid. Electrical and other connections for such structures and devices typically are formed in the space between the suspended ceiling and the permanent ceiling structure from which it is suspended so as not to be visible in the room below.

Perhaps the most common structures and devices, other than ceiling tiles, to be supported by a suspended ceiling grid are lighting fixtures. Over the years many different types of lighting fixtures have been developed for use in suspended ceilings and many structures and methods have been developed for attaching such fixtures to the suspended ceiling T-bar grid. A typical lighting fixture for use in a suspended ceiling includes a box like structure, sometimes called a troffer, having end and side walls, a top reflector closing one end of the end and side walls, and an open side opposite the top reflector. Lamps, such as fluorescent lamps, typically may be mounted within or suspended from the fixture box. Often the open side of the fixture box may be covered by a hinged or otherwise removable lens or louver, that disburses the light from the lamps but that can be easily removed to replace the lamps when necessary. Electrical connections for the fixture, including, typically, the fluorescent lamp ballast, typically are provided on the top of the top reflector, so as not to be visible from below when the lighting fixture is installed in a suspended ceiling.

Lighting fixtures of the type described typically are sized and designed such that they may be supported in the openings in a suspended ceiling grid along the bottom edges of the end and side walls thereof that are placed on the horizontal flanges of the T-bars surrounding the opening. Clamps or other structures often are used to secure the lighting fixture in position to the ceiling grid T-bars. Actually placing the lighting fixture in position within the T-bar grid can, however, prove to be a challenge. If the installer has access from above the suspended ceiling he can lower the lighting fixture into position on the T-bar grid from above. This, however, rarely is the case, as the space between the suspended ceiling grid and the permanent ceiling structure above typically does not provide enough room or access to allow the lighting fixture to be lowered into the suspended ceiling grid from above. The other option is to lift the lighting fixture into position from below. However, manipulating a lighting fixture that is several feet across through a suspended ceiling grid and into position from below is very cumbersome and often difficult.

One common solution to the problem of installing a lighting fixture as a substantially single piece in a suspended ceiling has been to provide a lighting fixture in several pieces that are assembled in position in the suspended ceiling to form the lighting fixture. Individual smaller pieces forming the lighting fixture are more easily moved into position in the suspended ceiling grid from below than an entire lighting fixture several feet across. Many such lighting fixtures that may be assembled in place in a suspended ceiling grid in this manner have been developed. However, none of the known solutions has proved entirely successful. Most such solutions require that many lighting fixture pieces be assembled together in a suspended ceiling grid using various fasteners and tools. As anyone who has done so can testify, manipulating many pieces, fasteners and tools while working over one's head is difficult, uncomfortable, and time consuming.

What is desired, therefore, is an improved lighting fixture for a suspended ceiling that can be mounted in a suspended ceiling from below the ceiling easily and quickly. Preferably, the lighting fixture can be assembled from a minimal number of pieces that can be installed in place in a suspended ceiling grid without requiring the manipulation of tools or fasteners.

SUMMARY OF THE INVENTION

The present invention provides a lighting fixture that may be easily and securely installed in a suspended ceiling from below the ceiling. The lighting fixture may comprise only four separate pieces to be installed, two end caps, a reflector assembly, and a ballast box cover. The two end caps are first slid into position at opposite ends of an opening in a suspended ceiling formed of a T-bar grid. The end caps are supported in position by the T-bar grid. The reflector assembly may be temporarily suspended from the end caps so that electrical connections to the assembly made and the ballast box cover installed. The entire reflector assembly may then easily be lifted into position into the suspended ceiling to be supported by the end caps mounted therein.

Each of the end cap pieces of a lighting fixture in accordance with the present invention may include a main plate portion including an inner surface and an outer surface, a top edge, and a bottom edge. A bottom flange extends outward toward the outer surface of the main plate portion from the bottom edge thereof and is adapted to rest on the horizontal flanges of the T-bar supports of a suspended ceiling in which the lighting fixture is installed. Mounting brackets extend inward from each end of the bottom edge of each plate portion and also are adapted to rest on the horizontal flanges of the T-bar supports. Each of the mounting brackets may include a plurality of bendable tabs extending substantially vertically upward from the mounting brackets. The bendable tabs are of different lengths, such that at least one of the plurality of bendable tabs on each mounting bracket is adapted to engage the vertical ribs of the T-bar supports of a suspended ceiling in which the end cap pieces are installed when the bendable tab is bent outward from the vertical position toward the vertical rib of the T-bar support. Each of the end cap pieces may also include a top flange extending inward from the top edge thereof and each of the mounting brackets may include at least one support tab extending inward therefrom approximately parallel with the inner surface of the main plate.

The reflector of a lighting fixture in accordance with the present invention may include a preferably curved reflector plate portion having an outer surface and an inner surface. A vertical flange portion extending upward along the non-curved edges of the reflector plate have mounting tabs formed therein that are adapted to engage the support tabs extending from the mounting brackets of the end caps. Support tabs extending from the other sides of the reflector are positioned thereon to engage the top flanges of the end cap pieces. These support tabs may extend from a ballast box portion of the reflector mounted on the outer surface of the reflector plate. A removable cover may be provided for the ballast box, and a lamp enclosure may be mounted on the outer surface of the reflector plate.

The end cap pieces may include shaped side edges including notches formed therein. Tabs extending from the ends of the non-curved edges of the reflector plate may be adapted to engage these notches to temporarily suspend the reflector from the installed end cap pieces while electrical connections are made to the reflector.

Further objects, features, and advantages of the present invention will be apparent from the following detailed description taken in conjunction with the accompanying drawings.

BRIEF DESCRIPTION OF THE DRAWINGS

FIG. 1 is an exploded perspective view of an exemplary lighting fixture in accordance with the present invention shown with respect to a portion of a suspended ceiling in which the lighting fixture may be installed.

FIG. 2 is a more detailed view of a portion of FIG. 1.

FIG. 3 is a perspective view illustration of exemplary end cap pieces for a lighting fixture in accordance with the present invention.

FIGS. 4-6 are views of the end cap pieces for a lighting fixture in accordance with the present invention as illustrated in FIG. 3 as taken along lines 4-4, 5-5, and 6-6 thereof, respectively.

FIGS. 14-17 are exemplary illustrations of steps in a method for installing a lighting fixture in accordance with the present invention in a suspended ceiling.

DETAILED DESCRIPTION OF THE INVENTION

Figure 7:
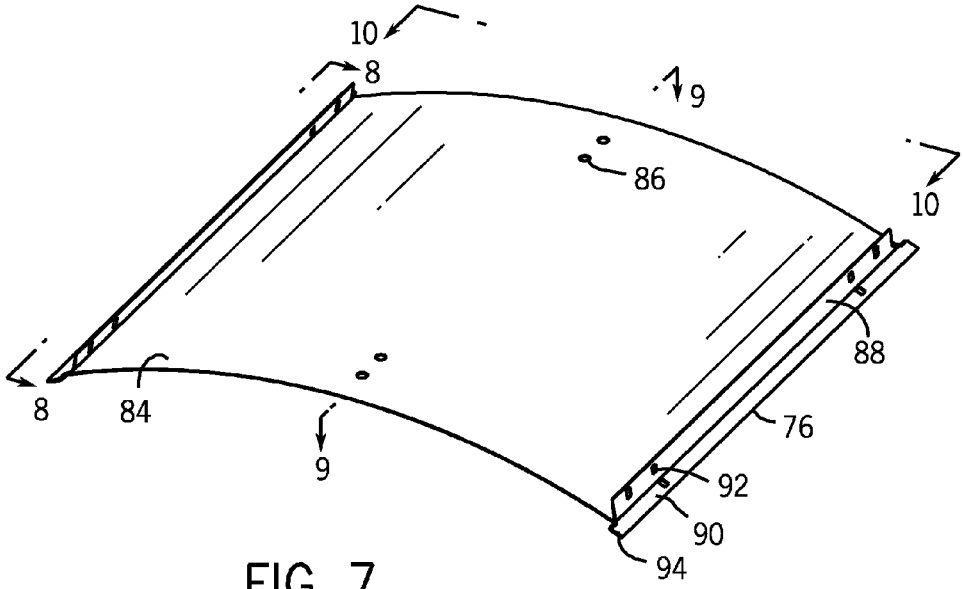
FIG. 7 is a perspective view illustration of an exemplary reflector plate portion of a reflector piece for a lighting fixture in accordance with the present invention.
Figure 8:
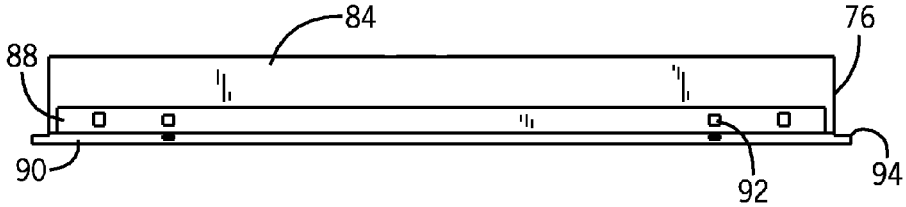
FIGS. 8-10 are views of the reflector plate portion of a reflector piece for a lighting fixture in accordance with the present invention as illustrated in FIG. 7 as taken along lines 8-8, 9-9, and 10-10 thereof, respectively.
Figure 9:
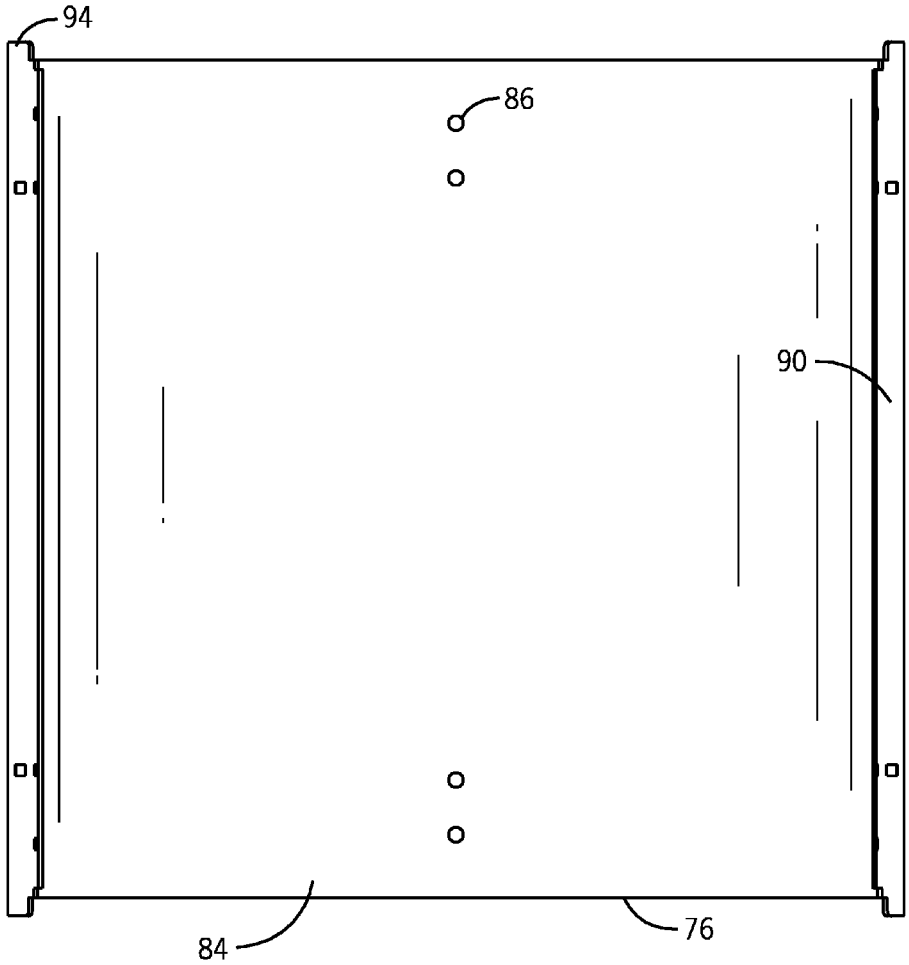
Figure 10:
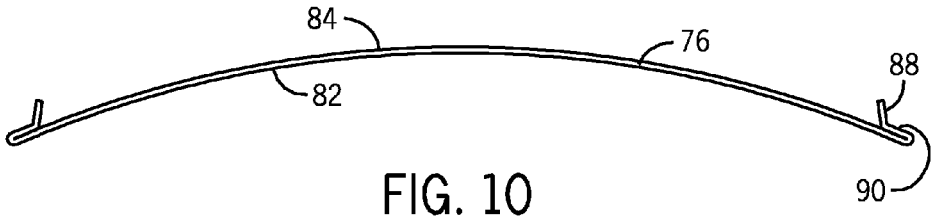

An exemplary lighting fixture in accordance with the present invention first will be described in detail herein, followed by a detailed description of a method for installing such a lighting fixture in a suspended ceiling. An exemplary lighting fixture 30 in accordance with the present invention for installation in a suspended ceiling 32 is illustrated in, and will be described in detail first with reference to, FIG. 1. As discussed above, a typical suspended ceiling 32 in which a lighting fixture 30 in accordance with the present invention may be installed is formed of a grid of T-bar beams 34. As illustrated in more detail in the view of FIG. 2, each of the T-bar beams 34 has a vertical rib 36 from the bottom of which horizontal flanges 38 extend along the length of the T-bar 34 to form the inverted T-shaped cross section thereof. The interlocked grid of T-bars 34 is suspended from a permanent ceiling or other structure located above the ceiling grid using wires and/or other support structures (not shown). The T-bars 34 are laid out in a pattern defining square or rectangular openings 40 therein. The present invention will be described herein with reference to a ceiling grid having square openings that are generally 2 feet by 2 feet in size and a lighting fixture 30 sized to fit in such a sized opening. It should be understood, however, that the present invention also may incorporated in lighting fixtures of other and different sizes designed to be mounted in suspended ceilings having ceiling grid openings of different sizes, e.g., 2 feet by 4 feet openings. Conventional ceiling tiles 42 are supported in most of the openings 40 of the suspended ceiling grid in a conventional manner, i.e., by supporting the tiles 42 along the edges thereof by the horizontal flanges 38 of the T-bars 34 forming the ceiling grid around the grid openings in which the ceiling tiles 42 are supported. A lighting fixture 30 in accordance with the present invention is designed to be mounted in an opening 40 in the suspended ceiling grid in place of a ceiling tile 42.

A lighting fixture in accordance with the present invention preferably has a minimal number of pieces that may be assembled in place in a suspended ceiling. As illustrated in FIG. 1, for example, a lighting fixture 30 in accordance with the present may include only four such pieces: two identical end cap pieces or end caps 44 (only one of which is shown in FIG. 1), a reflector 46, and a cover 48. As will be discussed in more detail below, a lighting fixture 30 in accordance with the present invention is installed easily into a suspended ceiling 32 from below by first positioning the end caps 44 in the suspended ceiling grid, hanging the reflector 46 in position in the opening in the suspended ceiling 32 between the end caps 44 to connect electrical power, from a power supply connection 50, to a ballast box 78 portion of the reflector 46, covering the ballast box portion of the reflector 46 with the cover 48, and lifting the reflector into position to be supported in the suspended ceiling 32 by the end caps 44. Each of the components of the exemplary lighting fixture 30 in accordance with the present invention now will be described in more detail. It should be noted that each of the end caps 44, reflector 46 and cover 48 may be manufactured in a conventional manner of conventional materials used in lighting fixtures. For example, these pieces may be formed of sheet aluminum or a similar material that is bent or otherwise formed into shape to form the pieces desired as described below.

Exemplary end caps 44 for a lighting fixture 30 in accordance with the present invention are illustrated in detail in FIGS. 3-6, and will be described in detail with reference thereto. Note that a lighting fixture 30 in accordance with the present invention employs two such end caps 44. Since the two end caps 44 employed may be identical, only one such end cap 44 will be described in detail herein. The end cap 44 has a main plate portion 52 having an inner surface 54 and an outer surface 56. As will be seen, the inner surface 54 of the plate portion 52 of the end cap 44 is that portion thereof that will be adjacent to the reflector 46 when installed, and which is visible in the room below the ceiling 32 in which the lighting fixture 30 is installed. The inner surface 54 of the plate portion 52 of the end cap 44 thus preferably is a finished surface, e.g., having a painted or otherwise bonded white or other color surface finish. The plate portion 52 of the end cap 44 has a top edge 58 and a bottom edge 60. The top edge 58 may be shorter than the bottom edge 60 of the plate portion 52, giving to the plate portion 52 the general shape of a truncated triangle, with sloped side edges 62 of the plate portion 52 of the end cap connecting the ends of the top edge 58 to the ends of the bottom edge 60 thereof. The sloped side edges 62 may include one or more notches 63 formed therein. As will be described in more detail below, these notches 63 may be used to suspend the reflector 46 of the lighting fixture 30 in position where it is to be installed in a suspended ceiling 32 temporarily as electrical connections are made thereto. A top flange 64 is provided extending along the top edge 58 of the plate portion 52. The top flange 64 extends inward, i.e., in the direction of the inner surface 54 of the plate portion 52, at an angle, e.g., of approximately 45 degrees with respect thereto. One or more apertures 66 may be formed in the top flange 64. A bottom flange 68 is provided extending along the bottom edge 60 of the plate portion 52. The bottom flange 68 extends outward, i.e., in the direction of the outer surface 56 of the plate portion 52, at a right angle thereto.

A mounting bracket 70 is provided extending at a right angle from each end of the plate portion 52 of the end cap 44 adjacent to the bottom edge 60 thereof. The mounting bracket 70 extends inward from the ends of the plate portion 52, i.e., toward the inner surface 54 thereof. A plurality of bendable tabs 72 of varying height preferably are formed extending upward from the mounting bracket 70 along the length thereof extending perpendicular to the plate portion. As will be discussed in more detail below, during installation of a lighting fixture 30 in accordance with the present invention, one of the bendable tabs is bent to support the end cap 44 in position in the suspended ceiling 32 in which it is being installed. One or more support tabs 74 are formed extending at a right angle from a distal end of the mounting bracket 70, i.e., from the end thereof opposite the plate portion 52 of the end cap 44. Thus, the support tabs 74 extend parallel with the plate portion 52 opposite the inner surface 54 thereof. As will be discussed in more detail below, the support tabs 74 are employed to support the reflector piece 46 in position in a suspended ceiling via the end caps 44 mounted therein.

A reflector 46 of a lighting fixture 30 in accordance with the present invention may include three major components: a reflector plate 76, a ballast box 78, and a lamp enclosure 80. Note that preferably each of these components are combined into a single piece by the lighting fixture manufacturer so that they may be installed as a single reflector 46, as described above, when the lighting fixture 30 is installed in a suspended ceiling 32. For completeness, and ease of illustration and description, however, each of these component parts now will be described in more detail separately.

As illustrated in FIGS. 7-10, the reflector plate 76 portion of the reflector 46 has an inner surface 82 and an outer surface 84 and is generally curved in one dimension. E.g., the reflector plate 76 is concave with respect to the inner surface 82 thereof. The inner surface 82 of the reflector plate 76 is that portion of the reflector 46 which, when installed, may be visible in the room below the ceiling 32 in which the lighting fixture 30 is installed. The inner surface 82 of the reflector plate 76 thus, preferably, is a finished surface, e.g., having a painted or otherwise bonded white or other color surface finish. The curvature of the reflector plate 76 may be generally parabolic and may be smooth, as illustrated, or prismatic, i.e., formed as a series of generally flat surfaces joined along the edges thereof to form a curved surface. Of course any curvature may be employed. Mounting holes 86 may be formed extending through the reflector plate 76, e.g., at the center of the reflector plate along the apex of the curvature thereof. As will be discussed in more detail below, the mounting holes 86 are provided for mounting the ballast box 78 and lamp enclosure 80 portions of the reflector 46 to the reflector plate 76. Two flanges are formed extending along the length of the non-curved edges of the reflector plate 76, a vertical flange 88 and a horizontal flange 90. The vertical flange 88 extends upward from the non-curved edge of the reflector plate, i.e., in the direction of the outer surface 84 of the reflector plate 76. The vertical flange 88 has mounting holes 92 formed therein. As will be discussed in more detail below, the mounting holes 92 are used in combination with the mounting tabs 74 formed on the mounting bracket 70 of the end caps 44 to mount the reflector 46 to the end caps 44 mounted in the suspended ceiling 32 into which the lighting fixture 30 is to be installed.

The horizontal flange 90 is formed as that portion of the reflector plate 76 extending beyond the vertical flange 88. The horizontal flange 90 thus may maintain and continue the curvature of the reflector plate 76 to the non-curved edges thereof. The horizontal flange 90 preferably is slightly longer than the length of the non-curved edge of the reflector plate, thereby forming tabs 94 at the ends thereof. As will be described in more detail below, these tabs 94 formed at the edges of the reflector plate 76 may be used to suspend the reflector 46 of the lighting fixture 30 in position where it is to be installed in a suspended ceiling 32 temporarily as electrical connections are made thereto.

Figure 11:
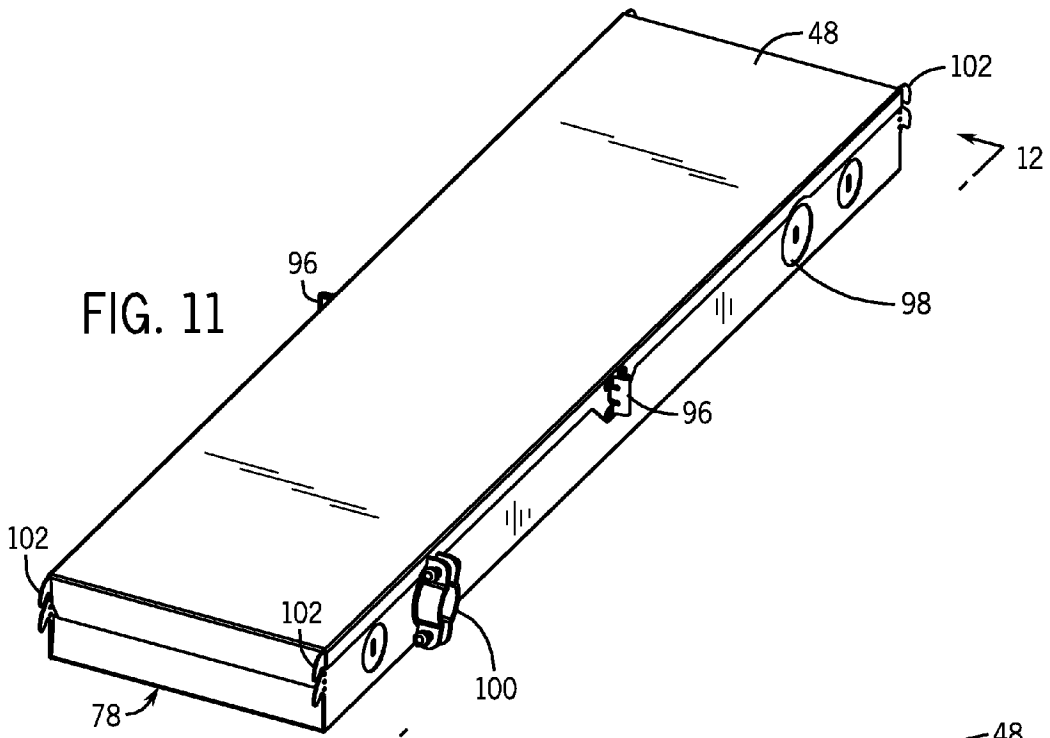
FIG. 11 is a perspective view illustration of an exemplary ballast box portion of a reflector piece and an exemplary cover piece for a lighting fixture in accordance with the present invention.
Figure 12:
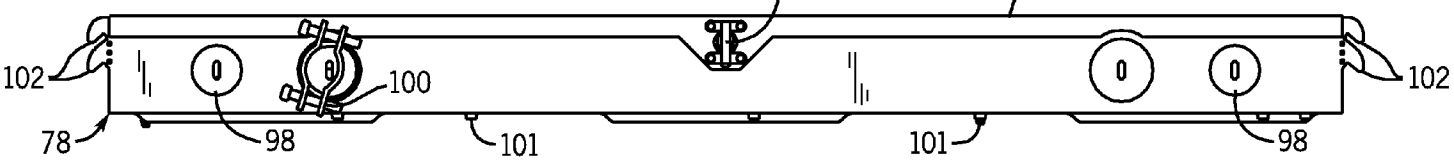
FIG. 12 is a view of the ballast box portion of a reflector piece and the cover piece for a lighting fixture in accordance with the present invention as illustrated in FIG. 11 as taken along line 12-12 thereof.

As illustrated in FIGS. 11 and 12, the ballast box 78 portion of the reflector 46 is formed as a generally box shaped structure having an open top that is covered by the cover 48. The cover 48 thus forms a removable top for the ballast box 78, such that the interior of the ballast box 78 is substantially entirely enclosed when the cover 48 is in place thereon. Conventional fasteners may be used to removably attach the cover 48 to the ballast box 78. Preferably the fasteners used to removably attach the cover 48 to the ballast box 78 do not require the use of any tools during installation. For example, conventional quarter turn fasteners 96 may be mounted on the ballast box 78 in a conventional manner to be turned by hand to engage the appropriate conventional structures on the cover to removably attach the cover to the ballast box 78 during installation.

The ballast box 78 is designed to contain the fluorescent lamp ballast and other electrical components required by a fluorescent lighting fixture 30 in accordance with the present invention. Electrical power is provided to the lighting fixture 30 via, e.g., the power supply connection 50, to the ballast and other electrical components contained in the ballast box 78. One or more conventional break-away or break-out portions 98 may be provided in one or more side walls of the ballast box 78 (and/or in the cover 48), to provide access by the power supply connection to the interior of the ballast box 78. A conventional wiring, cable, or conduit connector 100 may be mounted in one or more of these break-outs 98 to provide for connecting the power supply connection 50 to the ballast box 78. The type of connector 100 to be employed will depend upon the type of wiring or other electrical conduit forming the power supply connection 50. One or more apertures, such as threaded conduits 101, may be formed and/or provided through a bottom surface of the ballast box 78 to provide for the extension of electrical wiring therefrom to the fluorescent lamp or lamps mounted in the lamp enclosure 80 to be described in more detail below.

The ballast box 78 is mounted to the outer surface 84 of the reflector plate portion 76 of the reflector 46. As illustrated, the ballast box 78 may be mounted to the outer surface of the reflector plate 76 at the center of the curvature thereof and extending along the non-curved length thereof. Any conventional method may be used to mount the ballast box 78 to the outer surface 84 of the reflector plate. For example, appropriate fasteners may be extended from the bottom of the ballast box 78 through the mounting holes 86 formed in the reflector plate 76 to mount the ballast box 78 to the reflector plate 76. As will be described in more detail below, the threaded conduits 101 on the ballast box 78 may be extended through the mounting holes 86 formed in the reflector plate 76 to which the lamp enclosure 80 then is attached thereby to mount both the ballast box 78 and the lamp enclosure 80 to the reflector plate 78.

The ballast box 78 preferably is dimensioned to be approximately as long as the reflector plate 76 to which it is mounted. Support tabs 102 or another similar structure preferably are formed extending from each end of the ballast box, such that the support tabs 102 extend from the ballast box 78 in the direction of the non-curved direction of the reflector plate. As illustrated, the support tabs 102 or other similar structure preferably extend slightly downwardly, in the direction of the reflector plate 76, as they extend from the ballast box 78, to provide a somewhat hook shaped structure. Preferably these tabs may be formed at or near each corner of the ballast box 78. As illustrated, preferably multiple, e.g., two, such support tabs 102 are provided, one above the other, at each of the four corners of the ballast box 78. The providing of multiple rows of support tabs 102 in this manner provides for use of a single lighting fixture 30 in accordance with the present invention in different types of suspended ceilings 32. As also will be discussed in more detail below, during installation of a lighting fixture 30 in accordance with the present invention in a suspended ceiling 32, the support tabs 102 extending from the ballast box 78 interact with the top flanges 64 of the end caps 44 to support the reflector 46 in position in the suspended ceiling 32 via the end caps 44 already mounted therein.

Figure 13:
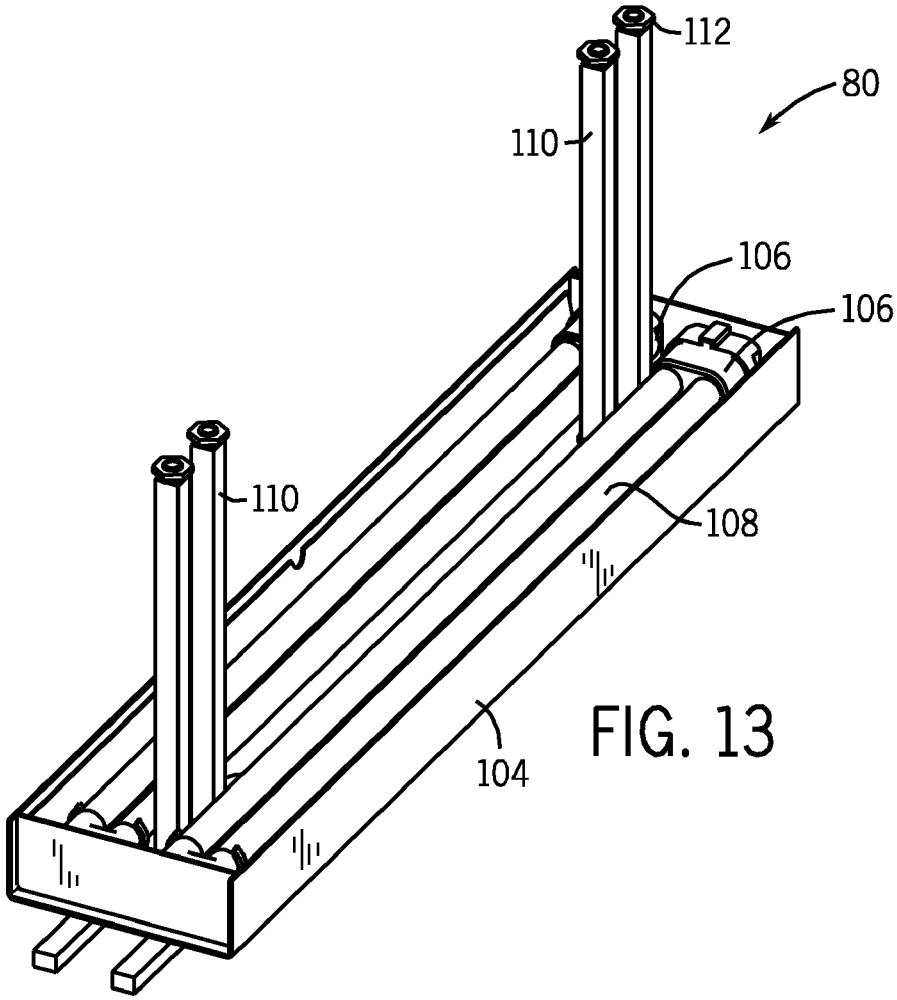
FIG. 13 is a perspective view of an exemplary lamp enclosure portion of a reflector piece for a lighting fixture in accordance with the present invention.

An exemplary lamp enclosure 80 portion of a reflector 46 of a lamp fixture 30 in accordance with the present invention is illustrated in FIG. 13, and will be described in detail with reference thereto. An exemplary pendant type lamp enclosure 80 is illustrated and described herein. It should be noted, however, that a variety of different types of lamp enclosures in a variety of different styles and configurations, and providing either direct or indirect lighting, may be employed in accordance with the present invention. The exemplary lamp enclosure 80 includes a lamp enclosure box 104. In the embodiment illustrated, the lamp enclosure box 104 has a bottom and side walls but no top wall, and thus opens upwardly. Conventional fluorescent lamp mounts 106 are mounted in the lamp enclosure box 104, and fluorescent tube lamps 108 are mounted in the lamp mounts 106 in a conventional manner. One or more pair of fluorescent lamp mounts 106 may be provided in the lamp enclosure box 104 for supporting one or more fluorescent lamps 108 therein. Lamp enclosure supports 110 are mounted to the lamp enclosure box 104 and extend upward therefrom. The lamp enclosure box 104, with the lamp mounts 106 and lamps 108 therein, is suspended from the reflector plate 76 of the reflector 46 via the lamp enclosure supports 110 such that when the lamps 108 are turned on the light from the lamps is directed upward from the lamp enclosure box 104 onto the inner surface 82 of the reflector plate 76 to be directed therefrom downward to provide indirect lighting for the room below. The lamp enclosure supports 110 may be connected to and suspended from the reflector plate 76 in any conventional manner. For example, threaded nut 112 or other structures may be provided at the tops of the lamp enclosure supports 110 to engage threaded conduits 101 or other structures extending from the bottom of the ballast box 78 through the mounting holes 86 in the reflector plate 76 thereby to attach both the ballast box 78 and the lamp enclosure 80 to the reflector plate 76. In such a case electrical wiring (not shown) may be run through one or more of the threaded conduits 101 through hollow portions of one or more of the lamp enclosure supports 110 to provide an electrical connection between the ballast and other electrical components in the ballast box 78 and the lamp mounts 106 in the lamp enclosure 104. In this manner the electrical wiring of the lighting fixture 30 is entirely hidden to those in the room below the ceiling 32 in which the lighting fixture 30 is installed. It should be understood, however, that other means, methods, and structures for providing electrical power to the lamps 108 may be employed.

An exemplary method for installing a lighting fixture 30 in accordance with the present invention in a suspended ceiling now will be described in detail. The preferred method of installation begins by installing two end caps 44 in position in an opening 40 formed by T-bars 34 of the suspended ceiling 32 at opposite ends of the opening. Before sliding the end caps 44 in position in the ceiling 32, one of the vertically extending support tabs 72 formed on the end caps is selected and bent outward slightly, e.g., about one-quarter inch. As illustrated in FIG. 2, the support tab 72 that is selected to be bent outward in this manner is the tab 72 having a distal end that will be positioned just beneath the lower edge 114 of the spar 116 formed along the top of the T-bar 34 when the end cap 44 is placed with the lower edge flange 68 thereof on the extending flange portion 38 of an adjacent T-bar 34. This process is then repeated for each set of extending support tabs, e.g., four tabs 72 total are bent outward in this manner, one on each side of each of the two end caps 44 employed. Each of the two end caps 44 are then slid into position in the suspended ceiling as illustrated in FIG. 14 (showing one of the two end caps 44 being installed). The outward bent tabs 72 of the end caps 44 catch against the vertical portion 36 and spar 116 of the T-bars on either side of the end caps, thus holding the end caps 44 in the desired position in the suspended ceiling. If desired, or required by local building codes, the end caps 44 may further be attached to and supported from the permanent ceiling above the suspended ceiling 32 by wires (not shown), e.g., attached to the holes 66 formed in the top flange 64 of the end caps 44.

In an alternative embodiment of the present invention, the tabs 72 provided on the end caps 44 may be made of a flexible material, such as spring steel, with all of the tabs 72 bent outward slightly before installation of the end caps 44 in a suspended ceiling 32. In this case, as the end cap 44 is installed in the ceiling 32 the flexible tabs 72 will be bent back inward as they contact the vertical portion 36 and spar 116 of the T-bar 34 against which they are being installed. At least one such flexible tab 72 at each end of the end cap 44, however, will remain bent outward slightly to engage the vertical portion 36 and spar 116 of the T-bar 34 to hold the end cap 44 in the desired position in the suspended ceiling 32. In this embodiment of the present invention, all of the flexible tabs 72 may come from the manufacturer ready to install in the slightly bent outward condition. Thus, the installer need not select and bend out a selected one of the tabs 72 prior to installation. It should be noted that, in this embodiment, only the portion of the end caps 44 including the support tabs 72 need be made of the flexible spring steel material. However, any such portion of, or the entire, end cap 44 may be made of such an appropriate material.

To connect the electrical power source 50 to the lighting fixture 30, the reflector 46 may be lifted in position and suspended from the end caps 44 mounted in the ceiling 32 temporarily, e.g., by positioning two of the tabs 94 at each end of one side of the reflector plate 76 portion of the reflector in the notches 63 provided for this purpose in the angled edge 62 of the opposed end caps 44. With the reflector 46 hanging in position and with the cover 48 removed, the electrical power source 50 can easily be connected to the ballast box 78 portion of the reflector, the appropriate electrical connections to the power source 50 made within the ballast box 78, and the cover 48 attached to the ballast box 78, e.g., using the fasteners 96 to close the ballast box 78.

Figure 16:
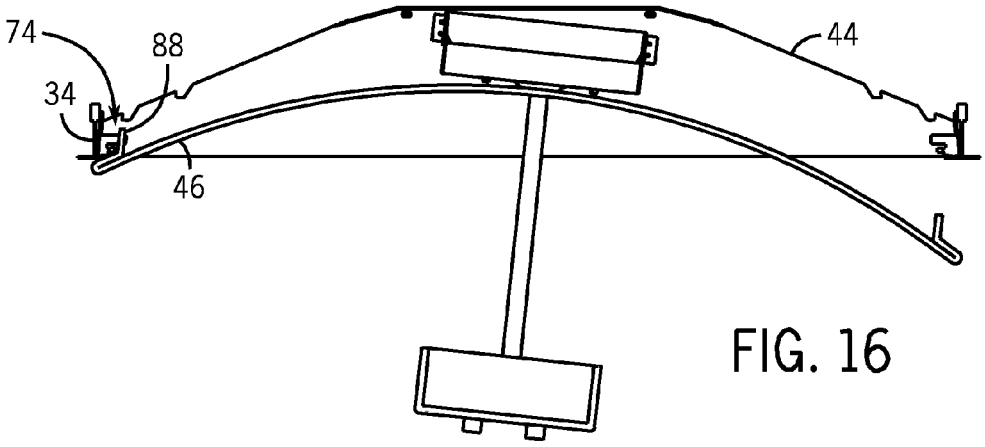
Figure 17:
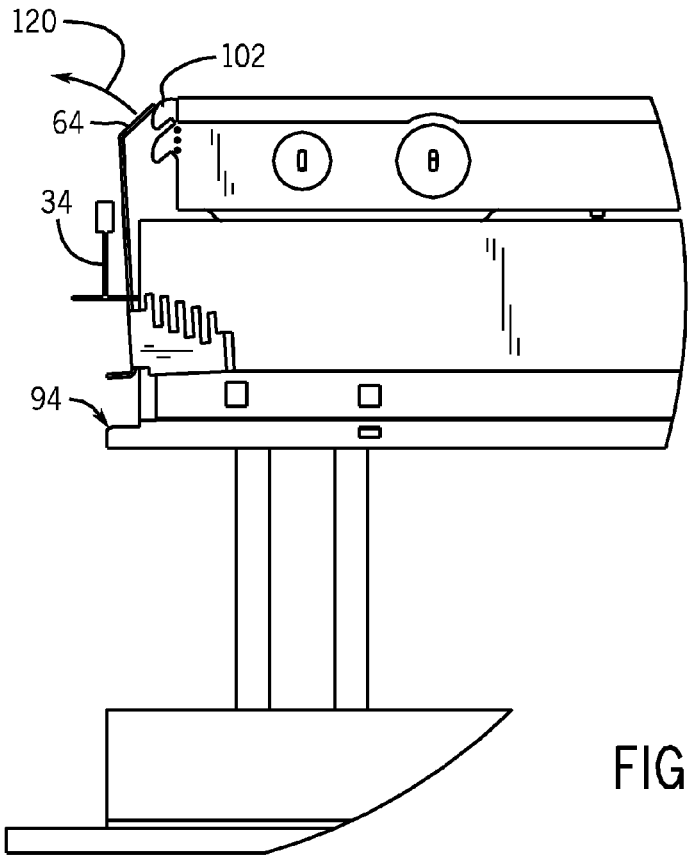

Once the required electrical connections are completed and the cover 48 is in place, the entire reflector 46 may be mounted in position on the end caps 44. As illustrated in FIGS. 15-17, this is accomplished first by positioning the reflector 46 such that the mounting holes 92 in the vertically extending flange portion 88 of one side of the reflector plate 76 portion of the reflector 46 are positioned over the extending mounting tabs 74 formed extending from opposed end caps 44 mounted in the suspended ceiling 32. The other edge of the reflector plate is moved upward and flexed slightly such that the mounting holes 92 in the vertically extending flange portion 88 on the other side of the reflector plate are in position over the corresponding mounting tabs 74 on the other sides of the end caps 44. As the reflector 46 is moved upward in this manner the hooked tabs 102 on the ballast box 78 cause the inward extending top flange 64 of the end caps 44 to be moved first outward 120 (see FIG. 17) and then to snap back into place under the tabs 102. Thus, the entire reflector assembly 46 is installed and held in position in the suspended ceiling via the end caps easily and securely.

It should be understood that the present invention is not limited by the particular exemplary applications and embodiments illustrated and described herein but embraces all such modified forms thereof as may come within the scope of the following claims.

What is claimed is:

1. A lighting fixture for installation in a suspended ceiling formed by a grid of T-bar supports including vertical ribs and horizontal flanges, comprising:

(a) two end cap pieces, each of the end cap pieces having a main plate portion including an inner surface and an outer surface, a top edge, and a bottom edge, a top flange extending toward the inner surface from the top edge, a bottom flange extending toward the outer surface from the bottom edge and adapted to rest on the horizontal flanges of the T-bar supports, and mounting brackets extending toward the inner surface from each end of the bottom edge and adapted to rest on the horizontal flanges of the T-bar supports, wherein each mounting bracket includes at least one support tab extending therefrom approximately parallel to the inner surface; and (b) a reflector including a reflector plate portion having an inner surface and an outer surface, vertical flange portions extending toward the outer surface along opposed first and second edges of the reflector plate and including mounting holes formed therein, wherein the mounting holes are adapted to engage the support tabs extending from the mounting brackets of the end cap pieces, and support tabs extending from opposite third and fourth sides of the reflector and positioned thereon to engage the top flanges of the end cap pieces, thereby to support the reflector on the end cap pieces via the vertical flanges and the support tabs when the end cap pieces are installed on the horizontal flanges of the T-bar supports of a suspended ceiling.

2. The lighting fixture of claim 1 wherein:

each of the end cap pieces includes sloped side edges extending between the top edges and bottom edges thereof and wherein the sloped side edges of the end cap pieces include notches formed therein; and the reflector plate includes tabs extending from ends of the first and second edges thereof in the direction of the support tabs and adapted to engage the notches formed in the sloped side edges of the end cap pieces whereby the reflector may be suspended temporarily from end cap pieces installed on the horizontal flanges of the T-bar supports of a suspended ceiling.

3. The lighting fixture of claim 1 wherein each of the end cap pieces includes a plurality of bendable tabs extending substantially vertically from the mounting brackets toward the top edge of the end cap piece and wherein at least one of the plurality of bendable tabs on each mounting bracket is adapted to engage the vertical ribs of the T-bar supports of a suspended ceiling in which the end cap pieces are installed when the at least one bendable tab is bent outward from the vertical position toward the vertical rib of the T-bar support.

4. The lighting fixture of claim 1 wherein the reflector plate is curved between the first and second edges thereof such that the reflector plate is concave with respect to the inner surface thereof.

5. The lighting fixture of claim 1 wherein the reflector includes a lamp enclosure attached to the inner surface of the reflector plate.

6. The lighting fixture of claim 1 wherein the reflector includes a ballast box attached to the outer surface of the reflector plate and wherein the support tabs extend from the ballast box portion of the reflector.

7. The lighting fixture of claim 6 wherein the ballast box includes an open side thereof and comprising additionally a ballast box cover adapted to be removably attached to the ballast box to close the open side thereof.

8. A lighting fixture for installation in a suspended ceiling formed by a grid of T-bar supports including vertical ribs and horizontal flanges, comprising:

(a) two end cap pieces, each of the end cap pieces having a main plate portion including an inner surface and an outer surface, a top edge, and a bottom edge, a bottom flange extending toward the outer surface from the bottom edge and adapted to rest on the horizontal flanges of the T-bar supports, and mounting brackets extending toward the inner surface from each end of the bottom edge and adapted to rest on the horizontal flanges of the T-bar supports, wherein each of the mounting brackets includes a plurality of bendable tabs extending substantially vertically from the mounting brackets toward the top edge of the end cap piece and wherein at least one of the plurality of bendable tabs on each mounting bracket is adapted to engage the vertical ribs of the T-bar supports of a suspended ceiling in which the end cap pieces are installed when the at least one bendable tab is bent outward from the vertical position toward the vertical rib of the T-bar support; and (b) a reflector adapted to be mounted to the end cap pieces after the end cap pieces are positioned on the T-bar supports of the suspended ceiling.

9. The lighting fixture of claim 8 wherein:

each of the end cap pieces includes a top flange extending toward the inner surface thereof from the top edge thereof and each of the mounting brackets includes at least one support tab extending therefrom approximately parallel to the inner surface, and the reflector includes a reflector plate portion having an inner surface and an outer surface, vertical flange portions extending toward the outer surface along opposed first and second edges of the reflector plate and including mounting holes formed therein, wherein the mounting holes are adapted to engage the support tabs extending from the mounting brackets of the end cap pieces, and support tabs extending from opposite third and fourth sides of the reflector and positioned thereon to engage the top flanges of the end cap pieces, thereby to support the reflector on the end cap pieces via the vertical flanges and the support tabs when the end cap pieces are installed on the horizontal flanges of the T-bar supports of a suspended ceiling.

10. The lighting fixture of claim 9 wherein:

each of the end cap pieces includes sloped side edges extending between the top edges and bottom edges thereof and wherein the sloped side edges of the end cap pieces include notches formed therein; and the reflector plate includes tabs extending from ends of the first and second edges thereof in the direction of the support tabs and adapted to engage the notches formed in the sloped side edges of the end cap pieces whereby the reflector may be suspended temporarily from end cap pieces installed on the horizontal flanges of the T-bar supports of a suspended ceiling.

11. The lighting fixture of claim 9 wherein the reflector plate is curved between the first and second edges thereof such that the reflector plate is concave with respect to the inner surface thereof.

12. The lighting fixture of claim 9 wherein the reflector includes a lamp enclosure attached to the inner surface of the reflector plate.

13. The lighting fixture of claim 9 wherein the reflector includes a ballast box attached to the outer surface of the reflector plate and wherein the reflector support tabs extend from the ballast box portion of the reflector.

14. The lighting fixture of claim 13 wherein the ballast box includes an open side thereof and comprising additionally a ballast box cover adapted to be removably attached to the ballast box to close the open side thereof.

15. A method for installing a lighting fixture in a suspended ceiling formed by a grid of T-bar supports including vertical ribs and horizontal flanges, comprising:

(a) providing two end cap pieces, each of the end cap pieces having a main plate portion including an inner surface and an outer surface, a top edge, and a bottom edge, a top flange extending toward the inner surface from the top edge, a bottom flange extending toward the outer surface from the bottom edge and adapted to rest on the horizontal flanges of the T-bar supports, and mounting brackets extending toward the inner surface from each end of the bottom edge and adapted to rest on the horizontal flanges of the T-bar supports, wherein each mounting bracket includes at least one support tab extending therefrom approximately parallel to the inner surface and a plurality of bendable tabs extending substantially vertically from the mounting brackets toward the top edge of the end cap piece;

(b) installing each of the two end cap pieces in opposite ends of an opening in the suspended ceiling formed by the T-bar supports by positioning the bottom flanges and mounting brackets thereof on the horizontal flanges of the T-bar supports and bending at least one of the bendable tabs on each of the mounting brackets outward from the vertical position to engage the vertical ribs of the T-bar supports to hold the end cap pieces in position in the suspended ceiling;

(c) providing a reflector including a reflector plate portion having an inner surface and an outer surface, vertical flange portions extending toward the outer surface along opposed first and second edges of the reflector plate and including mounting holes formed therein, and reflector support tabs extending from opposite third and fourth sides of the reflector; and (d) mounting the reflector to the end plates installed in the suspended ceiling by positioning the reflector tabs thereon to engage the top flanges of the end cap pieces and positioning the mounting holes on the vertical flange portions thereof to engage the support tabs on the mounting brackets of the end cap pieces.

16. The method of claim 15 wherein installing the end cap pieces includes bending a one of the plurality of bendable tabs on each mounting bracket outward from the vertical position to engage the vertical ribs of the T-bar supports of a suspended ceiling in which the end cap pieces are installed before installing the end cap pieces in the suspended ceiling.

17. The method of claim 15 wherein the plurality of bendable tabs on each mounting bracket are made of a flexible material and are all bent outward from the vertical position before installing the end cap pieces in the suspended ceiling.

18. The method of claim 15 wherein the reflector plate is curved between the first and second edges thereof such that the reflector plate is concave with respect to the inner surface thereof.

19. The method of claim 15 wherein:

each of the end cap pieces includes sloped side edges extending between the top edges and bottom edges thereof and wherein the sloped side edges of the end cap pieces include notches formed therein, the reflector plate includes tabs extending from ends of the first and second edges thereof in the direction of the reflector support tabs and adapted to engage the notches formed in the sloped side edges of the end cap pieces, and after installing each of the two end cap pieces in the suspended ceiling and before mounting the reflector to the end plates, inserting the reflector plate tabs in the notches formed in the end cap pieces to suspend the reflector temporarily from the end cap pieces and making electrical connections to the reflector while the reflector is thus temporarily suspended.

20. The method of claim 19 wherein the reflector includes a ballast box attached to the outer surface of the reflector plate, the support tabs extend from the ballast box portion of the reflector, and the box includes an open side thereof and providing additionally a ballast box cover and attaching the ballast box cover to the ballast box to close the open side thereof while the reflector is temporarily suspended.

* * * * *